US009351074B2

(12) United States Patent
Kim

(10) Patent No.: US 9,351,074 B2
(45) Date of Patent: May 24, 2016

(54) AUDIO SYSTEM AND AUDIO CHARACTERISTIC CONTROL DEVICE

(71) Applicant: Yamaha Corporation, Hamamatsu-Shi, Shizuoka-Ken (JP)

(72) Inventor: Sungyoung Kim, Rochester, NY (US)

(73) Assignee: Yamaha Corporation, Hamamatsu-shi (JP)

( * ) Notice: Subject to any disclaimer, the term of this patent is extended or adjusted under 35 U.S.C. 154(b) by 119 days.

(21) Appl. No.: 14/105,054

(22) Filed: Dec. 12, 2013

(65) Prior Publication Data

US 2014/0105429 A1 Apr. 17, 2014

Related U.S. Application Data

(63) Continuation of application No. PCT/JP2012/065271, filed on Jun. 14, 2012.

(30) Foreign Application Priority Data

Jun. 14, 2011 (JP) ..... 2011-131964
Jun. 5, 2012 (JP) ..... 2012-128450

(51) Int. Cl.

| | |
|---|---|
| ***H04R 5/02*** | (2006.01) |
| ***H04R 5/00*** | (2006.01) |
| ***H04R 7/04*** | (2006.01) |
| ***H04S 7/00*** | (2006.01) |
| ***H04R 3/12*** | (2006.01) |
| *H04R 19/02* | (2006.01) |

(52) U.S. Cl.

CPC .. *H04R 5/00* (2013.01); *H04R 3/12* (2013.01); *H04R 7/04* (2013.01); *H04S 7/30* (2013.01); *H04R 19/02* (2013.01)

(58) Field of Classification Search

CPC ..... H04R 5/02; H04S 3/00
USPC ..... 381/300
See application file for complete search history.

(56) References Cited

U.S. PATENT DOCUMENTS

| | | | |
|---|---|---|---|
| 5,440,639 | A | 8/1995 | Suzuki et al. |
| 5,555,306 | A | 9/1996 | Gerzon |
| 2006/0165242 | A1 | 7/2006 | Miki et al. |

(Continued)

FOREIGN PATENT DOCUMENTS

| | | | |
|---|---|---|---|
| JP | 05-191987 | A | 7/1993 |
| JP | 2004-168265 | A | 6/2004 |

(Continued)

OTHER PUBLICATIONS

European Search Report dated Oct. 2, 2014, for EP Application No. 12800891.9, seven pages.

(Continued)

*Primary Examiner* — Simon King
(74) *Attorney, Agent, or Firm* — Morrison & Foerster LLP

(57) ABSTRACT

An audio system includes plural speakers including a planar speaker configured to emit a plane wave on the basis of a received audio signal, and a controller configured to supply audio signals to the plural speakers respectively, and to set signal levels of audio signals to be supplied to the planar speaker and at least one speaker, other than the planar speaker, of the plural speakers in accordance with a control signal specifying a perceived distance of sound to be heard by a listener.

7 Claims, 11 Drawing Sheets

(56) References Cited

U.S. PATENT DOCUMENTS

| | | | | |
|---|---|---|---|---|
| 2007/0269062 | A1 | 11/2007 | Rodigast et al. | |
| 2008/0144864 | A1* | 6/2008 | Huon | H04R 1/20 381/305 |
| 2010/0060441 | A1 | 3/2010 | Iwamoto | |
| 2011/0069850 | A1* | 3/2011 | Harma | H04S 3/002 381/307 |
| 2013/0294624 | A1 | 11/2013 | Rodigast et al. | |

FOREIGN PATENT DOCUMENTS

| | | | |
|---|---|---|---|
| JP | 2006-092482 | A | 4/2006 |
| JP | 2006-238254 | A | 9/2006 |
| JP | 2007-028066 | A | 2/2007 |
| JP | 2008-522467 | A | 6/2008 |
| JP | 2009-077379 | A | 4/2009 |
| JP | 2010-004129 | A | 1/2010 |
| JP | 2010-050875 | A | 3/2010 |
| JP | 2010-058743 | A | 3/2010 |

OTHER PUBLICATIONS

International Preliminary Report on Patentability dated Dec. 17, 2013, for PCT/JP2012/065271, filed Jun. 14, 2012, eight pages.

Japanese Office Action mailed Nov. 11, 2014, for JP Patent Application No. 2012-128450, with English translation, 14 pages.

International Search Report mailed Jul. 17, 2012, for PCT Application No. PCT/JP2012/065271, with English translation, five pages.

Japanese Final Office Action dated Jun. 30, 2015, for JP Patent Application No. 2012-128450, with English translation, 11 pages.

Anonymous. (Nov. 10, 2015). "Loudspeaker," Wikipedia, the free encyclopedia, retrieved from internet: <https://en.wikipedia.org/wiki/Loudspeaker>, retrieved on Nov. 13, 2015, the whole document, 28 pages.

* cited by examiner

AUDIO SYSTEM AND AUDIO CHARACTERISTIC CONTROL DEVICE

CROSS REFERENCE TO RELATED APPLICATIONS

This application is a continuation of PCT application No. PCT/JP2012/065271, which was filed on Jun. 14, 2012 based on Japanese Patent Application (No. 2011-131964) filed on Jun. 14, 2011 and Japanese Patent Application (No. 2012-128450) filed on Jun. 5, 2012, the contents of which are incorporated herein by reference.

BACKGROUND OF THE INVENTION

1. Field of the Invention

The present invention relates to a technique for enhancing the realism of sound in movie theaters and home theaters.

2. Description of the Related Art

The multichannel surround technology is one audio technology that is widely employed in audio equipment used in movie theaters and home theaters. The multichannel surround technology is a technology which provides a listener(s) with highly realistic sound by controlling a sound image of sound that is reproduced together with an image of a video content using plural speakers that are disposed in front of and on the right and left of the listener(s). The ITU (International Telecommunication Union) issued recommendations relating to the arrangement positions of speakers in the multichannel surround technology. For example, in a 5-channel surround technique, a center-channel speaker is disposed in front of a viewer(s) (i.e., on the side where a screen is provided) and front-left and front-right speakers are disposed on the left and right of the center-channel speaker, respectively. Furthermore, a left surround speaker and a right surround speaker are disposed on the left and right of the viewer(s), respectively. Among these five speakers, the center-channel speaker is used for reproduction of sound to be localized in front of the viewer(s), such as speeches. The front-left and front-right speakers are used for sound image localization on the front-left of, in front of, or on the front-right of the viewer(s). The left surround speaker and the right surround speaker are used for reproduction of sound to be localized on the left or right of or behind the listener(s).

Incidentally, among video contents to show at movie theaters and home theaters are ones in which each frame reproduction image was subjected to processing for 3D vision. Such 3D video contents include many scenes that were taken so that viewers would feel as if persons appearing were located on the viewer(s)' side of the screen. In such scenes, the realism of sound could be enhanced further while a video content is showing if a viewer who hears a speech of a person were allowed to feel as if its sound source were close to his or her ears. However, the conventional multisurround technology cannot control the distance of sound a viewer feels when hearing sound emitted from speakers. The present invention has been made in view of the above problem, and an object of the present invention is to make it possible to control the distance of sound a listener feels when hearing sound emitted from speakers.

SUMMARY OF THE INVENTION

To achieve the above problem, there is provided an audio system comprising: plural speakers including a planar speaker configured to emit a plane wave on the basis of a received audio signal; and a controller configured to supply audio signals to the plural speakers respectively, and to set signal levels of audio signals to be supplied to the planar speaker and at least one speaker, other than the planar speaker, of the plural speakers in accordance with a control signal specifying a perceived distance of sound to be heard by a listener.

In the invention, the perceived distance of sound to be heard by a listener is controlled by setting the balance between the signal levels of audio signals to be supplied to the planar speaker and the at least one speaker other than the planar speaker. Therefore, the invention makes it possible to localize a sound image of the sound to be heard by the listener at a position nearer to the listener. Thus, the invention makes it possible to control the distance a listener feels when reproduction sounds of a 3D content are emitted from plural speakers so that it matches a perceived distance of a display item in a reproduction image of the 3D content the listener feels when viewing the reproduction image.

There are Patent documents 1-3 which disclose techniques relating to the perceived distance control of sound to be heard by a listener. However, the technique of JP-T-2008-522467 (WO 2006/058602) is to control the position/direction and the perceived distance of a sound source of sound by using an ordinary speaker and a wave field synthesis speaker together. The technique of JP-A-05-191987 is to control an acoustic feature of a sound that is emitted from a speaker disposed over a listener on the basis of an elevation angle of a sound source that is estimated from 2-channel (left and right) input signals L and R and their addition signal (L+R) and delay difference signal $\phi(L-R)$. The technique of U.S. Pat. No. 5,555,306 is such as to individually generate a signal containing a direct sound component and a signal containing an initial reflection sound component by performing signal processing on plural sound source signals and output an addition signal of these signals as a perceived-distance-controlled signal. Therefore, the techniques of Patent documents 1-3 are different from the content of the invention.

DETAILED DESCRIPTION OF THE EXEMPLARY EMBODIMENTS

Embodiments of the present invention will be hereinafter described with reference to the drawings.

<Embodiment 1>

Figure 1A:
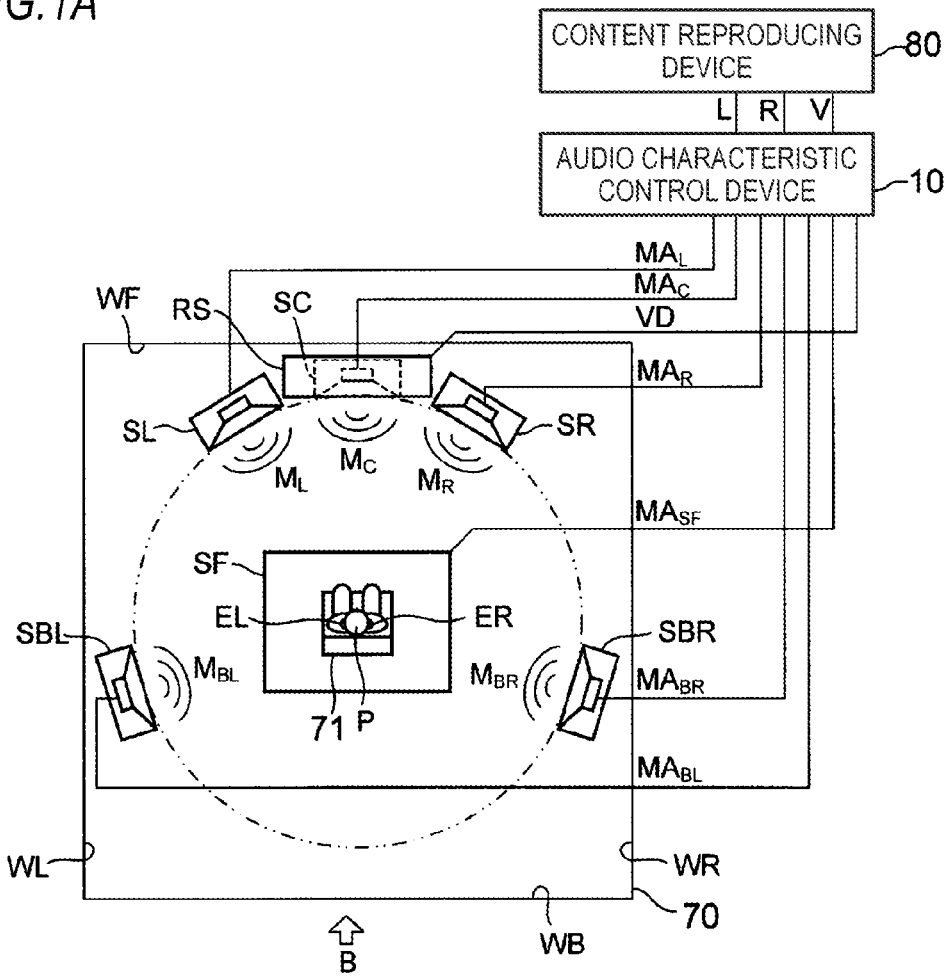
FIGS. 1A and 1B are a plan view and a front view, respectively, of a living room in which a 3D content viewing system including an audio system according to a first embodiment of the present invention is installed.
Figure 1B:
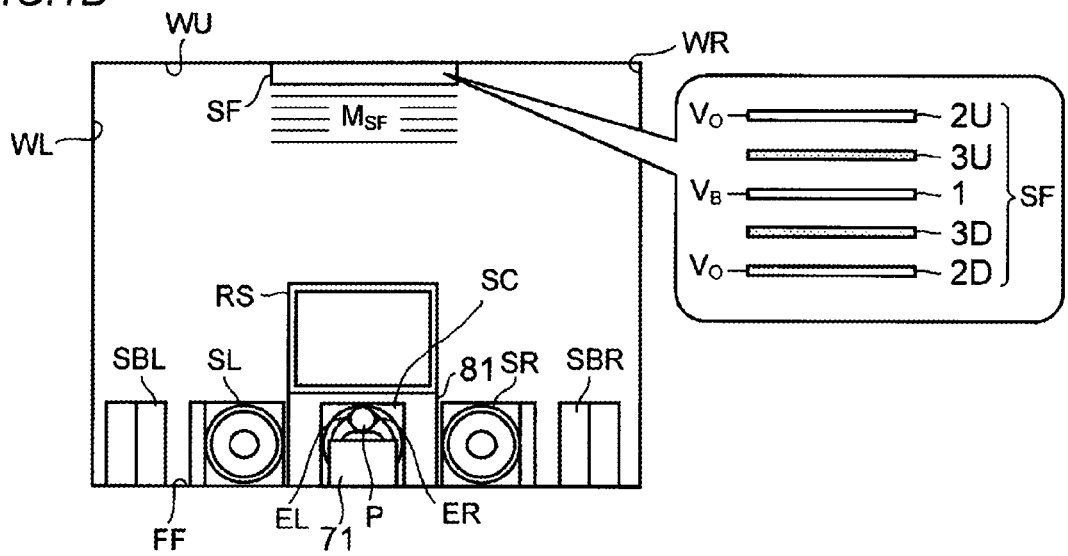

FIG. 1A is a plan view of a living room 70 in which a 3D content viewing system including an audio system according to a first embodiment of the invention is installed. FIG. 1B is a view of the living room as seen from the direction indicated by arrow B in FIG. 1A. The audio system according to this embodiment is a system which causes a viewer P sitting in the living room 70 to listen to reproduction sound that is reproduced together with a reproduction image of a 3D video content. In the living room 70 having a front wall WF, a rear wall WB, a left wall WL, and a right wall WR, a 3D TV receiver RS is placed on a TV rack 81 which is disposed inside a central portion of the front wall WF. The viewer P sits on a chair 71 placed at the center of the living room 70 wearing polarizing glasses G and watches a reproduction image displayed on the 3D TV receiver RS.

As shown in FIG. 1A, the audio system according to the embodiment includes a center-channel speaker SC, a front-left speaker SL, a front-right speaker SR, a left surround speaker SBL, and a right surround speaker SBR which are disposed on a floor FF of the living room 70 in front of (on the side where the 3D TV receiver RS is disposed), on the front-left of, on the front-right of, on the rear-left of, and on the rear-right of the viewer P, respectively, and a speaker SF which is attached to a ceiling WU so as to be located over (approximately right above) the viewer P. The audio system also includes a content reproducing device 80 and an audio characteristic control device 10 which is provided between the content reproducing device 80 and the speakers SC, SL, SR, SBL, SBR, and SF. The sound emitting surfaces of the six speakers SC, SL, SR, SBL, SBR, and SF which surround the viewer P are directed to the viewer P. The five speakers SC, SL, SR, SBL, and SBR disposed on the floor FF are speakers which emit sounds $M_C$, $M_L$, $M_R$, $M_{BL}$, and $M_{BR}$ which are non-plane sound waves (e.g., spherical waves) on the basis of audio signals $MA_C$, $MA_L$, $MA_R$, $MA_{BL}$, and $MA_{BR}$ supplied to them, respectively. The viewer P recognizes a direction of each of sound sources of the sounds $M_C$, $M_L$, $M_R$, $M_{BS}$, and $M_{BR}$ and perceives a sound image of each sound source in accordance with a difference between times of arrival at the left ear EL and right ear ER (i.e., a phase difference due to a sound propagation paths) and a sound pressure difference (i.e., an amplitude attenuation difference due to the sound propagation paths) of each of the sounds $M_C$, $M_L$, $M_R$, $M_{BL}$, and $M_{BR}$ emitted from the speakers SC, SL, SR, SBL, and SBR.

The speaker SF is a planar speaker which emits a sound $M_{SF}$ which is a plane wave on the basis of an audio signal $MA_{SF}$ supplied to the speaker SF. More specifically, as shown in a detailed diagram drawn in a right-hand frame in FIG. 1B, the speaker SF has a single vibration plate 1 and two electrode plates 2U and 2D between which the vibration plate 1 is interposed. Nonwoven fabrics 3U and 3D are interposed between the vibration plate 1 and the electrode plate 2U and between the vibration plate 1 and the electrode plate 2D, respectively. Plural holes to allow passage of a sound wave are formed through each of the electrode plates 2U and 2D. A DC bias voltage $V_B$ is applied to the vibration plate 1. Two-phase (positive/negative) signals $V_0$ and $-V_0$ ($|V_0|<V_B$) which constitute the input signal $MA_{SF}$ to the speaker SF are applied to the respective electrode plates 2U and 2D.

The electric field strength F1 (not shown) between the vibration plate 1 and the electrode plate 2U depends on the potential difference $V_B-V_0$ between the vibration plate 1 and the electrode plate 2U, and the electric field strength F2 (not shown) between the vibration plate 1 and the electrode plate 2D depends on the potential difference $V_B-(-V_0)$ between the vibration plate 1 and the electrode plate 2D. In the speaker SF, when the signal $V_0$ has a positive polarity and the signal $-V_0$ has a negative polarity, a relationship $(V_B-V_0)<\{V_B-(-V_0)\}$ holds. Since F1 becomes weaker than F2, the vibration plate 1 is displaced toward the electrode plate 2U. Conversely, when the signal $V_0$ has a negative polarity and the signal $-V_0$ has a positive polarity, a relationship $(V_B-V_0)>\{V_B-(-V_0)\}$ holds. Since F1 becomes stronger than F2, the vibration plate 1 is displaced toward the electrode plate 2D. In this manner, the vibration plate 1 is displaced toward the electrode plate 2U or the electrode plate 2D in accordance with the signals $V_0$ and $-V_0$. Every time the vibration plate 1 is displaced toward the electrode plate 2D, a sound wave (i.e., a compressional wave of air) is generated between the vibration plate 1 and the electrode plate 2D in accordance with the signals $V_0$ and $-V_0$. This sound wave passes through the electrode plate 2D and the holes formed through it and propagates downward as a sound $M_{SF}$ which is a plane wave. Unlike sounds $M_C$, $M_L$, $M_R$, $M_{BS}$, and $M_{BR}$ which a non-plane waves, after emitted from the speaker SF attached to the ceiling WU, the sound $M_{SF}$ reaches the left ear EL and right ear ER of the viewer P undergoing almost no attenuation.

Figure 2:
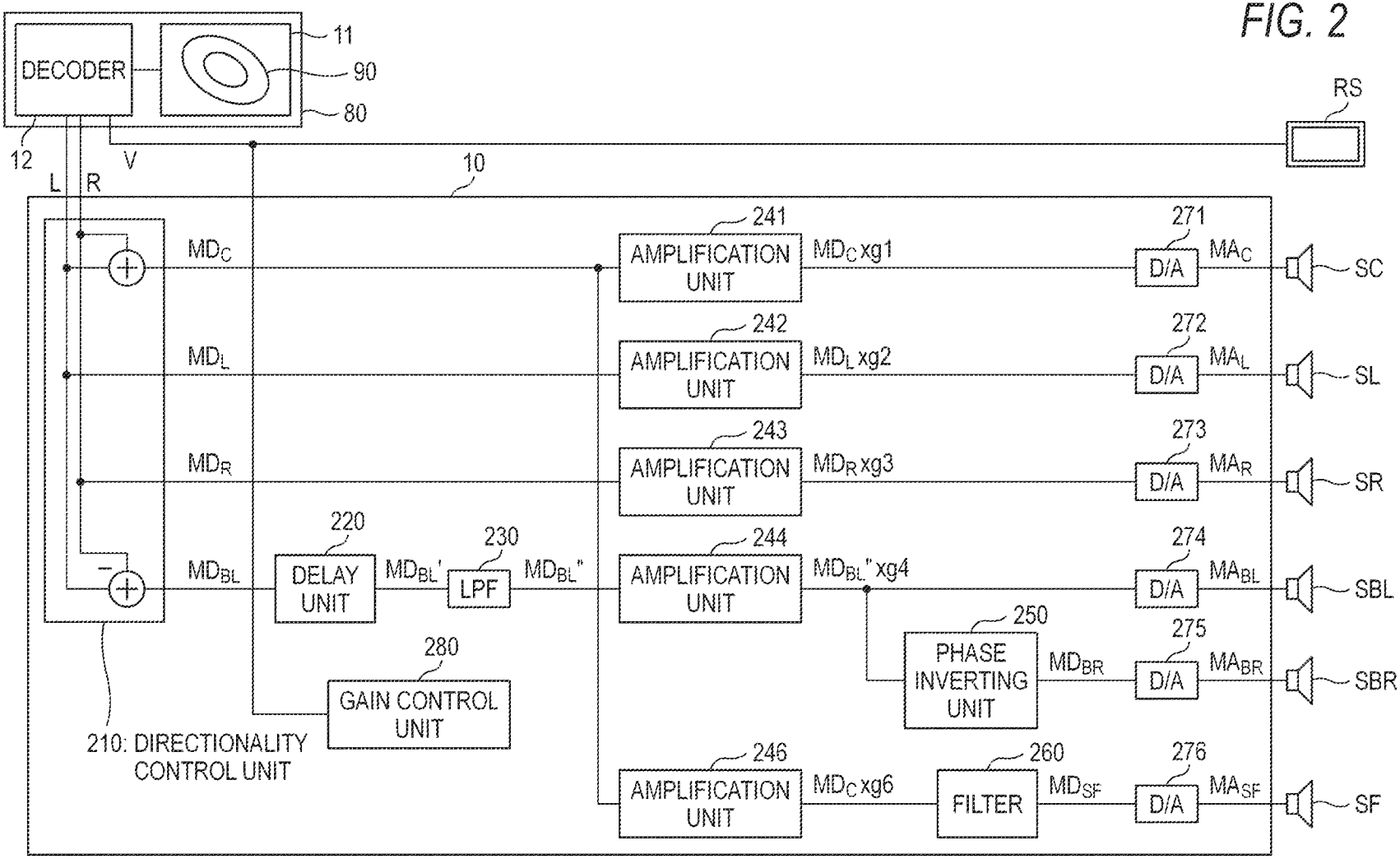
FIG. 2 is a block diagram showing the configuration of an audio characteristic control device of the same system.
Figure 3:
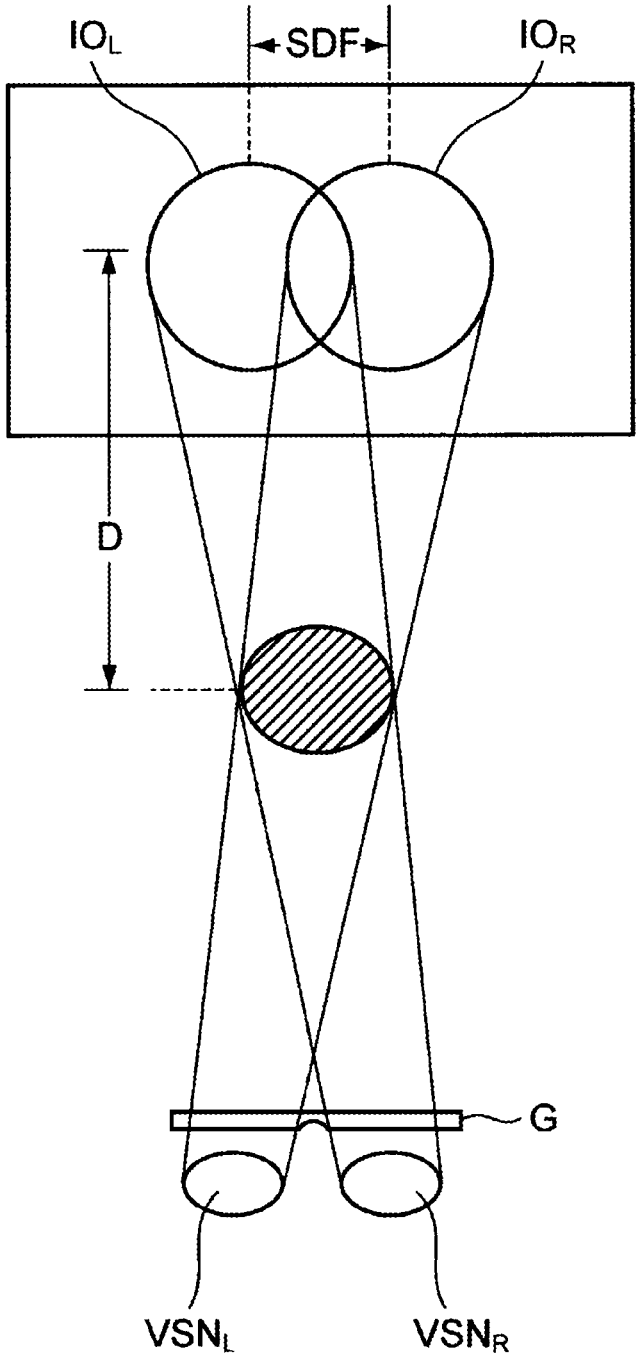
FIG. 3 illustrates the principle of 3D vision of a moving image content in the same system.

The content reproducing device 80 serves as a signal generation apparatus for generating an image signal V representing a reproduction image of a 3D video content and 2-channel (left and right) audio signals L and R representing corresponding reproduction sound. As shown in FIG. 2, the content reproducing device 80 is equipped with an optical drive 11 and a decoder 12. The optical drive 11 reads out a compression-coded signal of a 3D video content recorded in a recording medium 90 and supplies the read-out signal to the decoder 12. The decoder 12 generates an image signal V of a reproduction image and 2-channel (left and right) audio signals L and R of reproduction sound by performing decoding processing on the compression-coded signal. The decoder 12 supplies the signal V to the 3D TV receiver RS and supplies the signals V, L and R to the audio characteristic control device 10. The 3D TV receiver RS performs an operation of displaying a reproduction image in accordance with the output signal V of the content reproducing device 80. As shown in FIG. 3, a reproduction image of the 3D video content has a left-eye display item $IO_L$ and a right-eye display item $IO_R$ (in the following, a term "display item(s) IO" will be used when a left-eye display item $IO_L$ and a right-eye display item $IO_R$ are not discriminated from each other) which are spaced from each other (in the following, this interval will be referred to as a binocular parallax SDF). When the viewer P views this image through the polarizing glasses G, only one display item IO is imaged on the retina of each of the left eye $VSN_L$ and the right eye $VSN_R$. As a result, the viewer P misapprehends that the display item IO existed nearer to the viewer P by a distance D corresponding to the binocular parallax SDF which is the difference between the positions of the display items $IO_L$ and $IO_R$ recognized by the left eye $VSN_L$ and the right eye $VSN_R$, respectively, and thereby visually recognizes the reproduction image as a 3D image having depth.

The audio characteristic control device 10 generates 6-channel audio signals $MA_C$, $MA_L$, $MA_R$, $MA_{BL}$, and $MA_{BR}$, $MA_{SF}$ to be supplied to the respective speakers SC, SL, SR, SBL, SBR, and SF on the basis of the output signals L and R of the content reproducing device 80, and supplies the generated audio signals $MA_C$, $MA_L$, $MA_R$, $MA_{BL}$, $MA_{BR}$, and $MA_{SF}$ to the respective speakers SC, SL, SR, SBL, SBR, and SF. And the audio characteristic control device 10 serves to control the distance of a sound $M_C$ the viewer P feels when hearing it by adjusting the balance between the signal levels of the audio signals $MA_{SF}$ and $MA_C$ to be supplied to the speaker SF disposed over (almost right above) the viewer P and the front speaker SC, respectively, among the speakers SC, SL, SR, SBL, SBR, and SF.

As shown in FIG. 2, the audio characteristic control device 10 is equipped with a directionality control unit 210, a delay unit 220, an LPF (lowpass filter) 230, amplification units 241, 242, 243, 244, and 246, a phase inverting unit 250, a filter 260, D/A conversion units 271, 272, 273, 274, 275, and 276, and a gain control unit 280. The roles of the respective units will be described below. The directionality control unit 210 employs the sum (L+R) of the audio signals L and R as an audio signal $MD_C$ to be supplied to the speaker SC, and supplies the audio signal $MD_C$ to the amplification units 241 and 246. The directionality control unit 210 employs the audio signal L as an audio signal $MD_L$ to be supplied to the speaker SL, and supplies the audio signal $MD_L$ to the amplification unit 242. The directionality control unit 210 employs the audio signal R as an audio signal $MD_R$ to be supplied to the speaker SR, and supplies the audio signal $MD_R$ to the amplification unit 243. Furthermore, the directionality control unit 210 employs the difference L−R between the audio signals L and R as an audio signal $MD_{BL}$ to be supplied to the speaker SBL, and supplies the audio signal $MD_{BL}$ to the delay unit 220.

The amplification unit 241 amplifies the audio signal $MD_C$ supplied from the directionality control unit 210 at a gain g1. An audio signal ($MD_C$×g1) produced through the amplification by the amplification unit 241 is input to the D/A conversion unit 271. The D/A conversion unit 271 D/A-converts the audio signal ($MD_C$×g1) into an analog signal $MA_C$, supplies the analog signal $MA_C$ to the speaker SC, and thereby causes the speaker SC to emit a sound $M_C$. The amplification unit 242 amplifies the audio signal $MD_L$ supplied from the directionality control unit 210 at a gain g2. An audio signal ($MD_L$×g2) produced through the amplification by the amplification unit 242 is input to the D/A conversion unit 272. The D/A conversion unit 272 D/A-converts the audio signal ($MD_L$×g2) into an analog signal $MA_L$, supplies the analog signal $MA_L$ to the speaker SL, and thereby causes the speaker SL to emit a sound $M_L$. The amplification unit 243 amplifies the audio signal $MD_R$ supplied from the directionality control unit 210 at a gain g3. An audio signal ($MD_R$×g3) produced through the amplification by the amplification unit 243 is input to the D/A conversion unit 273. The D/A conversion unit 273 D/A-converts the audio signal ($MD_R$×g3) into an analog signal $MA_R$, supplies the analog signal $MA_R$ to the speaker SR, and thereby causes the speaker SR to emit a sound $M_R$.

The delay unit 220 delays the signal $MD_{BL}$ that is output from the directionality control unit 210 by a delay Δφ, and outputs a delayed audio signal $MD_{BL}'$. The delay Δφ of the delay unit 220 may be determined taking into consideration the magnitude of reverberation created in the living room 70 and other factors. The output signal $MD_{BL}'$ of the delay unit 220 is input to the LPF 230. The LPF 230 outputs, to the amplification unit 244, a signal $MD_{BL}''$ obtained by eliminating high-frequency components from the audio signal $MD_{BL}'$. The amplification unit 244 amplifies, at a gain g4, the signal $MD_{BL}''$ that is output from the LPF 230. An audio signal ($MD_{BL}''$×g4) produced through the amplification by the amplification unit 244 is input to the D/A conversion unit 274 and the phase inverting unit 250. The D/A conversion unit 274 D/A-converts the audio signal ($MD_{BL}''$×g4) into an analog signal $MA_{BL}$, supplies the analog signal $MA_{BL}$ to the speaker SBL, and thereby causes the speaker SBL to emit a sound $M_{BL}$. The phase inverting unit 250 outputs, to the D/A conversion unit 275, an audio signal $MD_{BR}$ obtained by inverting the phase of the signal ($MD_{BL}''$×g4). The D/A conversion unit 275 D/A-converts the audio signal $MD_{BR}$ into an analog signal $MA_{BR}$, supplies the analog signal $MA_{BR}$ to the speaker SBR, and thereby causes the speaker SBR to emit a sound $M_{BR}$.

The amplification unit 246 amplifies, at a gain g6, the audio signal $MD_C$ that is output from the directionality control unit 210. An audio signal ($MD_C$×g6) produced through the amplification by the amplification unit 246 is input to the filter 260. The filter 260 performs, on the signal ($MD_C$×g6), filtering processing for correcting a feature quantity RH that influences localization in the height direction in a head transfer function H of the viewer P (i.e., a sound transfer function from the center of the ears EL and ER of the viewer P to the external auditory canal inlet (or tympanum) of the viewer P with an assumption that the head of the viewer P is absent). The filter 260 outputs a signal $MD_{SF}$ produced through this filtering processing to the D/A conversion unit 276. More specifically, the filter 260 performs filtering processing for forming a dip $D_{RH}$ by attenuating a prescribed component in a frequency range (e.g., 6 to 8 kHz) including the feature quantity RH in the signal ($MD_C$×g6). And the filter 260 employs, as a signal $MD_{SF}$, a signal obtained by forming the dip $D_{RH}$ in the signal ($MD_C$×g6). The D/A conversion unit 276 D/A-converts the audio signal $MD_{SF}$ into an analog signal $MA_{SF}$, supplies the analog signal $MA_{SF}$ to the speaker SF, and thereby causes the speaker SF to emit a sound $M_{SF}$. The $M_{SF}$ has an effect of causing the viewer P to feel as if the sound source of the sound $M_C$ were near himself or herself, for the following reason. A sound $M_{SF}$ that is emitted from the speaker SF which is a planar speaker is much smaller in the rate at which the energy attenuates with the distance than a sound $M_C$ that is emitted from the speaker SC which is not a planar speaker, and hence causes almost no difference between a sound pressure of a sound heard at a near listening point and a sound pressure of a sound heard at a distant listening point. Usually, the viewer P listens to sounds that are emitted from nonplanar speakers. Therefore, even if sounds that reach the user P's left ear EL and right ear ER contain a plane wave that undergoes almost no attenuation as it travels, the user P does not realize that and recognizes (estimates) distances to sound sources mainly on the basis of volumes of the sounds. As a result, if a sound wave that should attenuates with the traveling distance as long as it is recognized according to the user P's ordinary sense of distance reaches his or her left ear EL and right ear ER without attenuation, the viewer P misapprehends that the sound were emitted from a near sound source. For the above reason, when a sound $M_{SF}$ which is a plane wave is emitted toward the viewer P at the same time as a sound $M_C$ which is not a plane wave, the viewer P feels as if the sound source of the sound $M_C$ is near.

The gain control unit 280 is a circuit for controlling the gains g1, g2, g3, g4, and g6 of the amplification units 241, 242, 243, 244, and 246. The gain control unit 280 controls the gains g1 and g6 in linkage in such a manner that the relationship of the following Equation (1) holds between the gain g1 of the amplification unit 241 and the gain g6 of the amplification unit 246. The gains g2-g4 are similar to gains that are set for the respective channels in ordinary surround systems.

$$g1^2+g6^2=1 \quad (1)$$

More specifically, every time a one-frame image signal V is supplied from the decoder 12 of the content reproducing device 80, the gain control unit 280 analyzes the image signal V and calculates a binocular parallax SDF of a display item 10 in the image represented by the image signal V. The binocular parallax SDF is a parameter for modifying the perceived distance of an object to be displayed to the viewer P and is increased or decreased in accordance with a target distance (more specifically, position in the front-rear direction). The gain control unit 280 uses the binocular parallax SDF as a control signal specifying a perceived distance of a sound to be heard by the viewer P, more specifically, a control signal specifying a position in the front-rear direction of a sound source to be perceived by the viewer P. The gain control unit 280 employs, as a gain g6 of the amplification unit 246, a value obtained by multiplying the binocular parallax SDF by a coefficient K1, and sets, as a gain g1 of the amplification unit 241, a value $(1-g6^2)^{1/2}$ which is obtained by substituting the gain G6 into the above-mentioned Equation (1).

This embodiment provides the following advantages:

First, in the embodiment, the perceived distances of sounds to be heard by the viewer P is controlled by adjusting the balance between the signal levels of audio signals $MA_C$ and $MA_{SF}$ to be supplied to the center-channel speaker SC and the planar speaker SF, respectively, among audio signals $MA_C$, $MA_L$, $MA_R$, $MA_B$, $MA_{BR}$, and $MA_{SF}$ to be supplied to the plural speakers SC, SL, SR, SBL, SBR, and SF. With this measure, the embodiment makes it possible to localize a sound image of a center-channel sound $M_C$ to be sensed by the viewer P at a position that is on the viewer P's side of a reproduction image of the 3D TV receiver RS. As a result, according to the embodiment, the distance of the reproduction sound $M_C$ of a 3D content that is felt by the viewer P when hearing the sound $M_C$ can be controlled so as to match a distance of a display item IO in the reproduction image of the 3D content that is felt by the viewer P when seeing the reproduction image.

Second, in the embodiment, the speaker SF is attached to the ceiling WU over (almost right above) the viewer P. Since the speaker SF is disposed over the viewer P, even if the viewer P turns his or her face in, for example, the left-right direction while viewing a 3D content, the viewer P feels no large difference between part of a sound $M_{SF}$ that reaches the left ear EL and part of the sound $M_{SF}$ that reaches the right ear ER and hence it is difficult for him or her to sense a distance. Therefore, even if the viewer P turns his or her face in, for example, the left-right direction while viewing a 3D content, the viewer P does not realize that the speaker SF exists over himself or herself. As such, the embodiment makes it easier to the control a perceived distance than in a case that the speaker SF is installed at another position.

Third, in the embodiment, the gain control unit 280 controls the gains g1 and g6 in linkage in such a manner that the relationship of the above-mentioned Equation (1) holds between the gain g1 of the amplification unit 241 and the gain g6 of the amplification unit 246. This makes it possible to change only the perceived distance of a sound without changing its sound volume as sensed by the viewer P by making a manipulation of, for example, increasing the gain g6 and decreasing the gain g1 accordingly if the distance D is large when a display item IO of a certain scene is viewed three dimensionally or decreasing the gain g6 and increasing the gain g1 accordingly if the distance D is small.

(Embodiment 2)]

Figure 4:
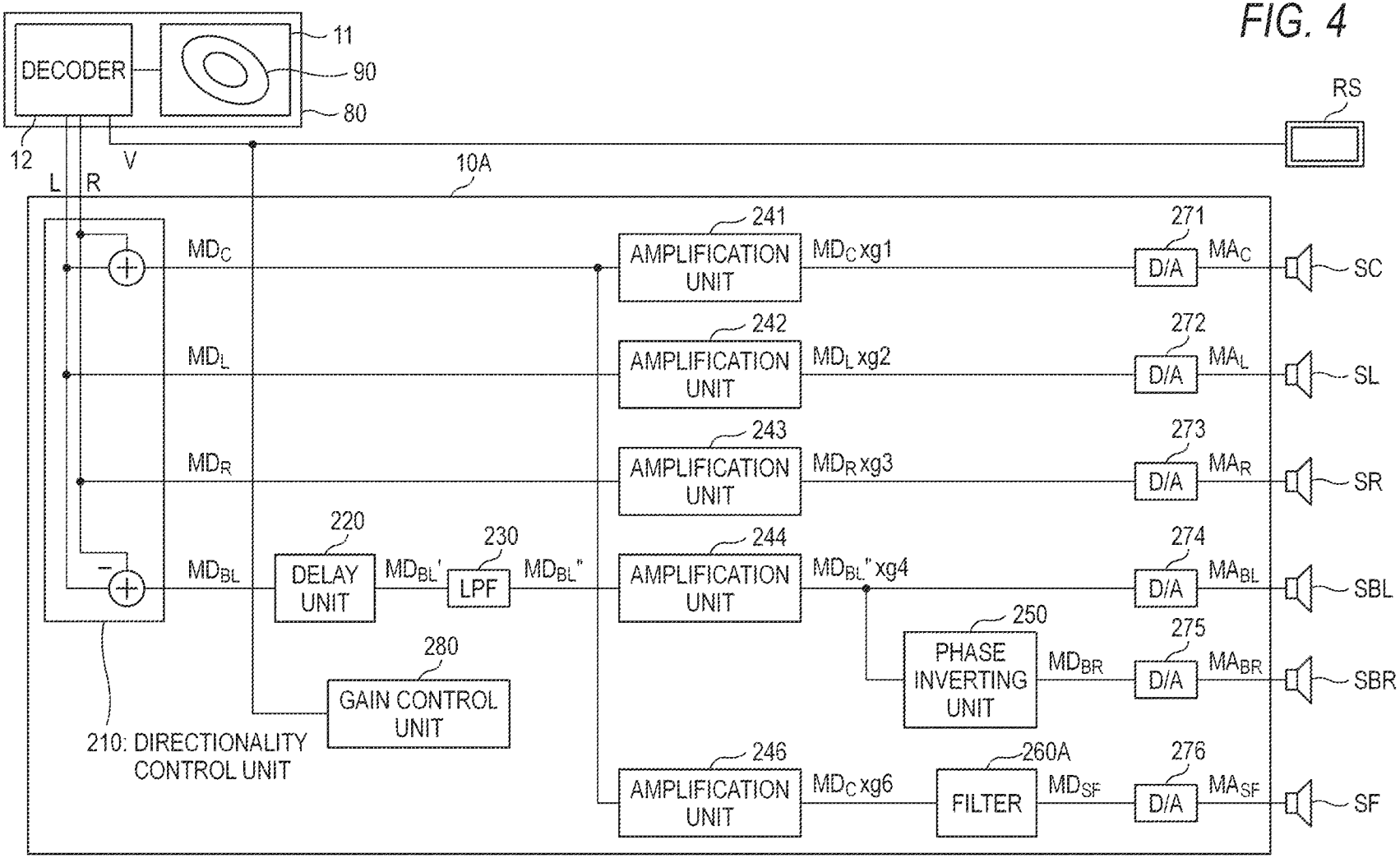
FIG. 4 is a block diagram showing the configuration of an audio characteristic control device of an audio system according to a second embodiment of the invention.

FIG. 4 is a block diagram showing the configuration of an audio characteristic control device 10A of an audio system according to a second embodiment of the invention. The audio characteristic control device 10A is different from the audio characteristic control device 10 (see FIG. 2) in that the filter 260 of the latter is replaced by a filter 260A. The filter 260A performs, as filtering processing, processing of convoluting a filter coefficient sequence $h_j$ (j=1, 2, . . . , g) corresponding to a function that is the reciprocal of a transfer function HA of the interval between the planar speaker SF and the viewer S (more specifically, a filter coefficient sequence $h_j$ (j=1, 2, . . . , g) obtained by performing inverse FFT (fast Fourier transform) on a function that is the reciprocal of the transfer function HA) into a signal ($MD_C \times g6$) to be supplied to the planar speaker SF. The audio characteristic control device 10A outputs a processing result $(MD_C \times g6)*h_j$ (j=1, 2, . . . , g) of this processing to the DIA conversion unit 276 as a signal $MD_{SF}$. In this embodiment, with the convolution processing, a sound $M_{SF}$ emitted from the planar speaker SF and a sound $M_C$ emitted from the speaker SC can be integrated together more strongly, whereby the accuracy of the perceived distance control can be increased.

(Embodiment 3)

Figure 5:
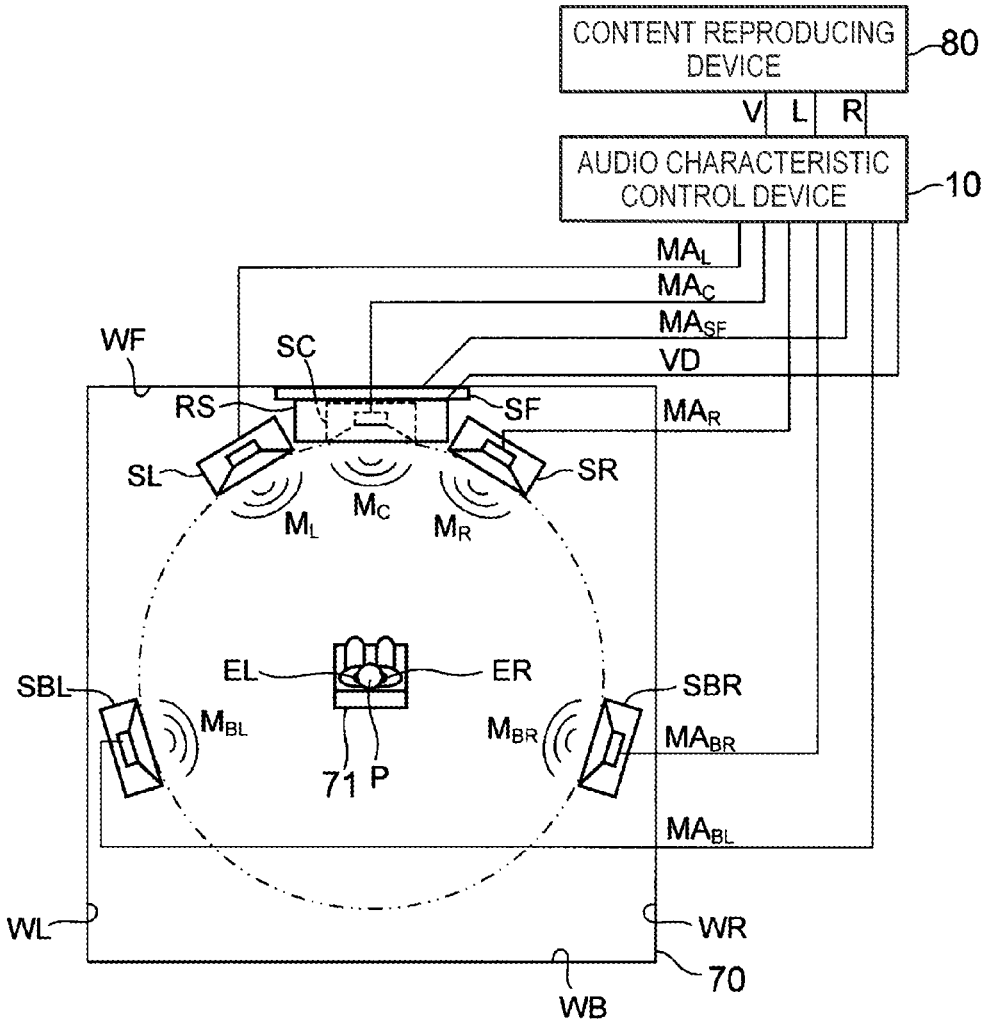
FIG. 5 is a plan view of a living room in which an audio system according to a third embodiment of the invention is installed.

FIG. 5 shows a living room 70 in which an audio system according to a third embodiment of the invention is installed. In this embodiment, the speaker SF is attached to the wall WF at a position in front of the viewer P. The emitting surface of the speaker SF is directed to the viewer P. This embodiment can provide the same advantages as the first embodiment. In addition, in this embodiment, since the speaker SF is attached to the front wall WF instead of the ceiling WU, the load of work of installing the speaker SF is lighter than in the first embodiment.

(Embodiment 4)

Figure 6:
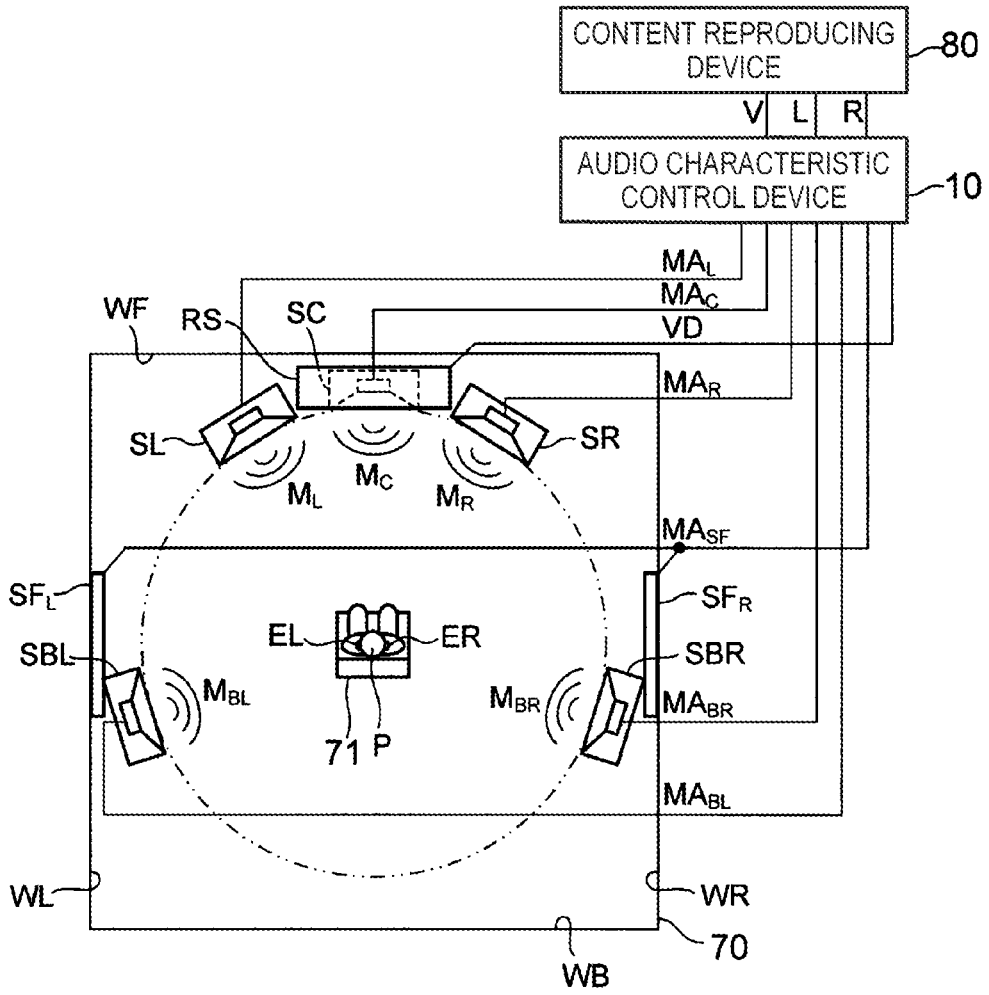
FIG. 6 is a plan view of a living room in which an audio system according to a fourth embodiment of the invention is installed.

FIG. 6 shows a living room 70 in which an audio system according to a fourth embodiment of the invention is installed. In this embodiment, a planar speaker $SF_L$ is attached to the left wall WL at a position on the left of the viewer P and a planar speaker $SF_R$ is attached to the right wall WR at a position on the right of the viewer P. The respective emitting surfaces of the speakers $SF_L$ and $SF_R$ are directed to the viewer P. The audio characteristic control device 10 supplies audio signals having the same amplitude and the same phase to the two speakers $SF_L$ and $SF_R$. This embodiment can provide the same advantages as the first embodiment. In addition, in this embodiment, since the speakers $SF_L$ and $SF_R$ are attached to the respective walls WL and WR instead of the ceiling WU, the load of work of installing the speakers $SF_L$ and $SF_R$ is lighter than in the first embodiment.

<Other embodiments>

Although the first to fourth embodiments of the invention have been described above, other embodiments of the invention are possible as exemplified below. Furthermore, some of the following modifications may be combined together as appropriate.

(1) In the above-described first, third, and fourth embodiments, the filter 260 performs the filtering processing for forming a dip $D_{RH}$ by attenuating a prescribed component in a band including a feature quantity RH in a signal ($MD_C \times g6$). The filter 260 may be a filter that is a combination of plural kinds of filters such as a band rejection filter that is a parallel connection of a lowpass filter that passes a component in a band that is lower than the band of the dip $D_{RH}$ and a high-pass filter that passes a component in a band that is higher than the band of the dip $D_{RH}$.

In the above-described first to fourth embodiments, the gain control unit 280 uses the binocular parallax SDF of a display item IO in an image represented by an image signal V as a control signal specifying a perceived distance of a sound to be heard by the viewer P and controls the gains g1 and g6 of the respective amplification units 241 and 246. Alternatively, it is possible to have the viewer P carry a remote controller for specifying a perceived distance of sound manually at will and control the gains g1 and g6 to desired values in accordance with a manipulation result of the remote controller by means of the gain control unit 280.

As a further alternative, a content producing apparatus may be constructed which records, in a recording medium, a control signal generated by manipulating the remote controller together with an image signal and audio signals. More specifically, an image signal V and 2-channel (left and right) audio signals L and R are reproduced and the viewer P is caused to view and listen to resulting video and sound. And a control signal is generated by having the viewer P control the perceived distance to a proper value by manipulating the remote controller. The control signal generated as a result of the manipulation of the remote controller and the original image signal V and two (left and right) audio signals L and R are compression-coded, and a resulting compression-coded signal of a 3D video content is recorded in the recording medium. The content reproducing device 80 reproduces the control signal together with the image signal V and the 2-channel (left and right) audio signals L and R from the recording medium in a synchronized manner and supplies the reproduced signals to the audio characteristic control device 10 or 10A.

This mode makes it possible to generate a control signal specifying a perceived distance as a result of a manipulation of the remote controller by the viewer P and produce a 3D video content containing the control signal. As a result, it becomes possible to produce a 3D video content that reflects taste of the viewer P.

(3) In the above-described first to fourth embodiments, the content reproducing device 80 outputs 2-channel (left and right) audio signals L and R to the audio characteristic control device 10 or 10A. And the audio characteristic control device 10 or 10A generates 6-channel audio signals $MA_C$, $MA_L$, $MA_R$, $MA_{BL}$, $M_{BR}$, and $M_{SF}$ and controls the balance between the signal levels of the audio signal $MA_C$ to be supplied to the center-channel speaker SC and the audio signal $M_{SF}$ to be supplied to the planar speaker SF among the audio signals $MA_C$, $MA_L$, $MA_R$, $MA_{BL}$, $M_{BR}$, and $M_{SF}$. Alternatively, the content reproducing device 80 may generate 6-channel audio signals $MA_C$, $MA_L$, $MA_R$, $MA_{RL}$, $M_{BR}$, and $M_{SF}$ to be supplied to the respective speakers SC, SL, SR, SBL, SBR, and SF and outputs them to the audio characteristic control device 10 or 10A.

(4) In the above-described embodiments, the five speakers SC, SL, SR, SBL, and SBR which are disposed on the floor FF are nonplanar speakers. Alternatively, all or part of the speakers SC, SL, SR, SBL, and SBR may be planar speakers. As a further alternative, all or part of the speakers SC, SL, SR, SBL, and SBR may be an array speaker. In this case, audio signals $MA_C$, $MA_L$, $MA_R$, $MA_B$, $M_{BR}$, and $M_{SF}$ may be emitted toward the viewer P by utilizing reflection of sound beams that are generated by disposing the array speaker in front of (not around) the viewer P.

Figure 7:
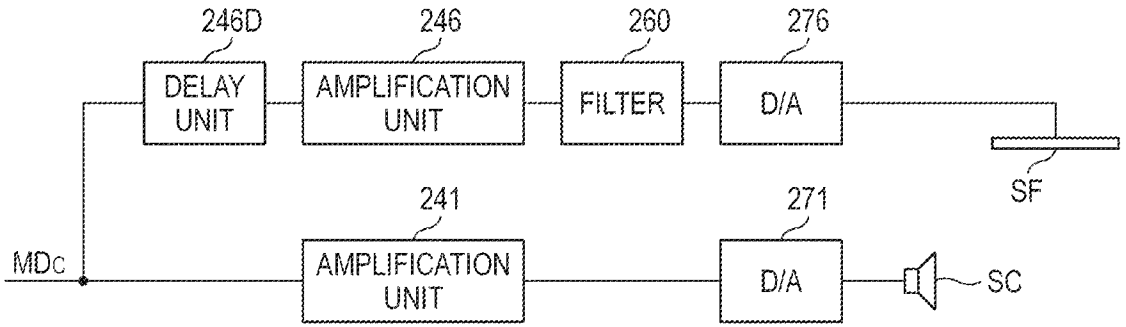
FIG. 7 is a block diagram showing another example configuration of the audio characteristic control device according to each of the above embodiments.

(5) In the above-described first embodiment, in general, the sound propagation distance from the ceiling speaker SF to the viewer P is longer than that from the front speaker SC to the viewer P. To compensate for a time difference due to this difference between the sound propagation distances, a configuration as shown in FIG. 7 may be employed in which a delay unit 246D for delaying an audio signal to be supplied to the amplification unit 246 is added so that the arrival of a sound emitted from the front speaker SC to the viewer P is timed with that of a sound emitted from the ceiling speaker SF to the viewer P.

(6) In the above-described first to fourth embodiments, the balance between the gains g1 and g6 of respective audio signals $MA_C$ and $MA_{SF}$ is adjusted by controlling both of the gains g1 and g6. Alternatively, the balance between the gains g1 and g6 of respective audio signals $MA_C$ and $MA_{SF}$ may be adjusted by making the signal level of the audio signal $MA_C$ a fixed value and varying the signal level of the audio signal $MA_{SF}$ or making the signal level of the audio signal $MA_{SF}$ a fixed value and varying the signal level of the audio signal $MA_C$.

(7) In the above-described first to fourth embodiments, a signal $MD_C$ to be supplied to the speaker SC among the five speakers SC, SL, SR, SBL, and SBR disposed on the floor FF is employed as the target of the perceived distance control and a signal $MA_{SF}$ to be supplied to the speaker SF is generated from the signal $MD_C$. Alternatively, a signal $MA_{SF}$ to be supplied to the speaker SF may be generated from one of an audio signal $MD_C$ to be supplied to the speaker SC, an audio signal $MD_L$ to be supplied to the speaker SL, an audio signal $MD_R$ to be supplied to the speaker SR, an audio signal $MD_{BL}$ to be supplied to the speaker SBL, and an audio signal $MD_{BR}$ to be supplied to the speaker SBR. As a further alternative, a signal $MA_{SF}$ to be supplied to the speaker SF may be generated from an addition signal of signals to be supplied to two or more the five speakers SC, SL, SR, SBL, and SBR or an addition signal of all of five kinds of audio signals $MD_{SF}$, $MD_L$, $MD_R$, $MD_{BL}$, and $MD_{BR}$. For example, in an audio system that is configured in such a manner that a virtual sound source is formed at desired positions in a living room 70 by sounds $M_L$ and $M_R$ of speakers SL and SR disposed on the front-left and front-right of a viewer P in the living room 70, a signal $MA_{SF}$ to be supplied to the speaker SF may be generated from an addition signal ($MD_L$+$MD_R$) of an audio signal $MD_L$ to be supplied to the speaker SL and an audio signal $MD_R$ to be supplied to the speaker SR. In this configuration, it is possible to let the viewer P feel as if the virtual sound source were near. Furthermore, audio signals to be supplied to plural planar speakers SF may be generated individually. For example, a configuration is possible in which two or more planar speakers SF are provided and an audio signal $MA_{SF}$-1 to be supplied to one planar speaker SF-1 is generated from an audio signal $MD_L$ to be supplied to the speaker SL and an audio signal $MA_{SF}$-2 to be supplied to the other planar speaker SF-2 is generated from an audio signal $MD_R$ to be supplied to the speaker SR.

Figure 8:
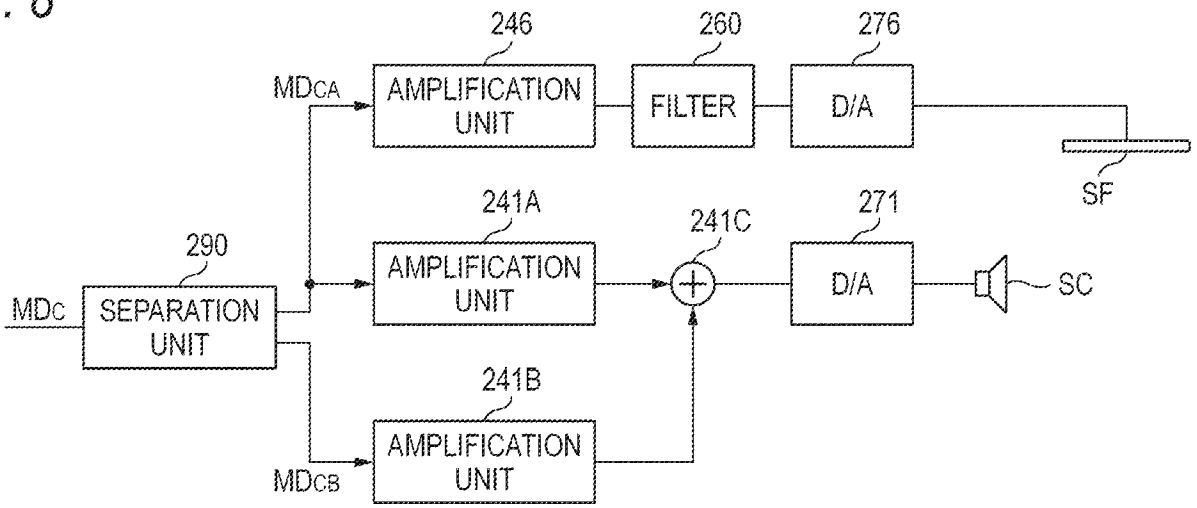
FIG. 8 is a block diagram showing another example configuration of the audio characteristic control device according to each of the above embodiments.

(8) In the above-described first embodiment, a signal of a component as a target of the perceived distance control (e.g., a component of a speech, an effect sound, or the like) may be extracted from an audio signal $MD_C$ to be supplied to the speaker disposed in front of the viewer P and supplied to both of the speaker SC and the planar speaker SF. FIG. 8 is a block diagram showing an example configuration of this mode. In this example, an audio signal $MD_C$ is separated by a separation unit 290 into an audio signal $MD_{CA}$ of a component as a target of the perceived distance control and an audio signal $MD_{CB}$ of a component that is not a target of the perceived distance control. The audio signal $MD_{CB}$ of the component that is not a target of the perceived distance control is amplified at a prescribed gain by an amplification unit 241B and supplied to an adder 241C. On the other hand, the audio signal $MD_{CA}$ of the component as a target of the perceived distance control is supplied to amplification units 241A and 246. Like those of the amplification units 241 and 246 used in the above-described first embodiment, the gains of the amplification units 241A and 246 are controlled on the basis of a control signal specifying a perceived distance of sound to be heard by the viewer P. An output signal of the amplification unit 241A is supplied to the adder 241C, and an output signal of the amplification unit 246 is supplied to the D/A conversion unit 276 after being processed by the filter 260. An output signal of the D/A conversion unit 276 is supplied to the planar speaker SF and output as a sound. The adder 241C outputs, to the D/A conversion unit 271, an addition signal of the output signals of the amplification unit 241A and the audio signal $MD_{CB}$ of the component that is not a target of the perceived distance control. An output signal of the D/A conversion unit 271 is supplied to the planar speaker SC and output as a sound.

In this mode, an audio signal $MD_{CA}$ of a component as a target of the perceived distance control is extracted from an audio signal $MD_C$ to be supplied to the speaker SC and amplified at gains that are determined on the basis of a control signal specifying a perceived distance, and resulting signals are supplied to the respective speakers SC and SF. As a result, the perceived distance control can be performed on only the particular component of the audio signal $MD_C$ to be supplied to the speaker SC.

The separation unit 290 may have any of various configurations. For example, a bandpass filter may be used which passes an audio signal in a band in which a component of a speech, an effect sound, or the like exists.

Also in a case that an audio signal to be supplied to the planar speaker SF is generated from audio signals to be supplied to, for example, the front-left speaker SL and the front-right speaker SR as in Modification (7), only a signal of a component as a target of the perceived distance control may be extracted from each audio signal and supplied to both speakers.

(9) In the above-described second embodiment, the filter 260A performs, as filtering processing, processing of convoluting a filter coefficient sequence $h_j$ (j=1, 2, . . . , g) corresponding to a function that is the reciprocal of a transfer function HA of the interval between the planar speaker SF and the viewer S into a signal ($MD_C \times g$6) to be supplied to the planar speaker SF. Alternatively, a filter coefficient sequence corresponding to a function that is the reciprocal of a head transfer function H may be convoluted. As a further alternative, a filter coefficient sequence corresponding to a function that is the reciprocal of a transfer function (HA+H) which is the sum of the transfer function HA and the head transfer function H may be convoluted.

Figure 9A:
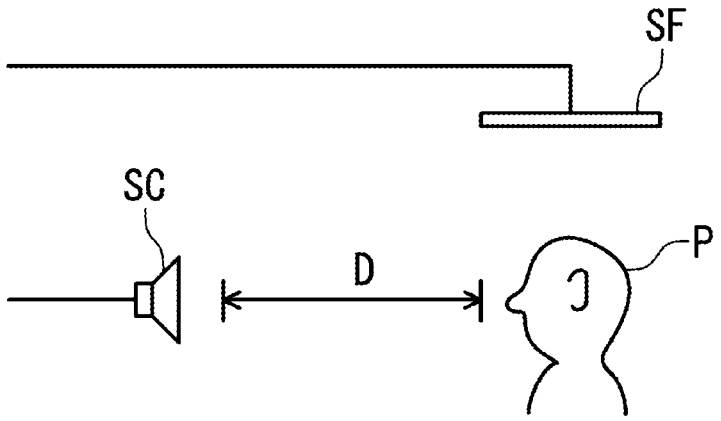
FIGS. 9A and 9B illustrate another example combination of speakers used for perceived distance control in each of the above embodiments.
Figure 9B:
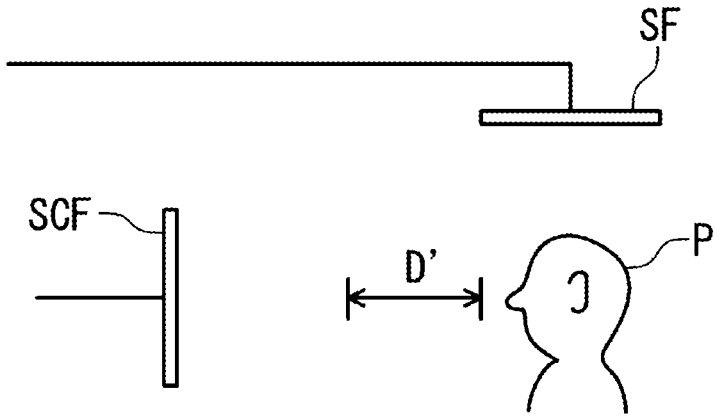

(10) In each of the above-described embodiments, as illustrated in FIG. 9A, the perceived distance control of a sound to be heard by the viewer P is performed using the combination of the planar speaker SF and the nonplanar speaker SC. Alternatively, as shown in FIG. 9B, a configuration is possible in which the speaker SC is replaced by a speaker (planar speaker) SCF which emits a plane wave and the perceived distance control is performed using the combination of the two speakers (planar speakers) SF and SCF which emit plane waves toward the viewer P from different directions. In the configuration which uses the combination of the planar speaker SF and the nonplanar speaker SC as shown in FIG. 9A, the perceived distance control can be performed in a range D from a position in the vicinity of the speaker SC to a position in the vicinity of the viewer P. In the configuration which uses the planar speakers SF and SCF as shown in FIG. 9B, the perceived distance control can be performed in a range D' which is on the side of the viewer P and narrower than the range D.

Figure 10:
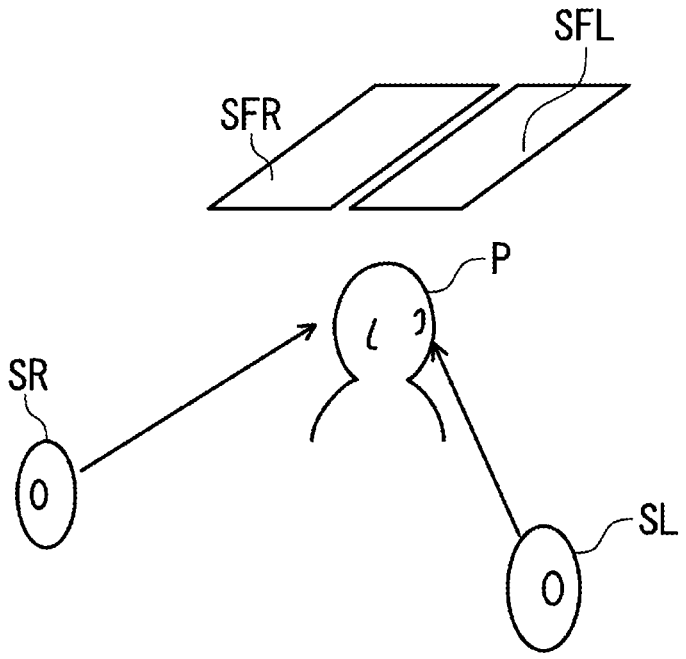
FIG. 10 illustrates an audio system according to another embodiment of the invention.
Figure 11:
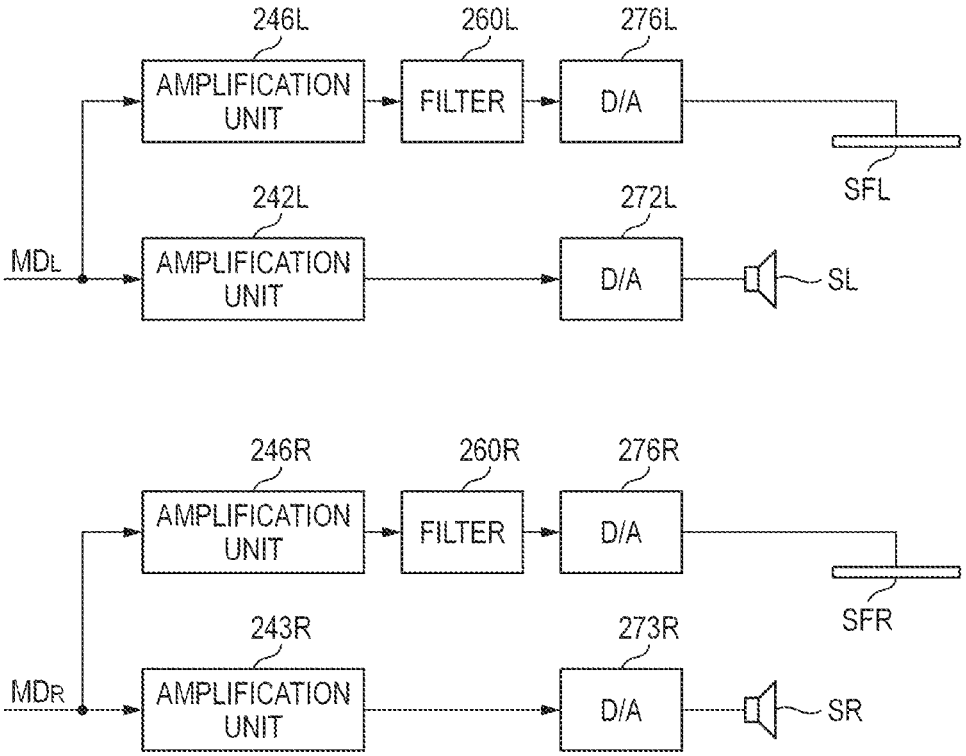
FIG. 11 is a block diagram showing the configuration of a signal processing system of the same audio system.

(11) The perceived distance control of sound to be heard by the left ear of the viewer P and that of sound to be heard by his or her right ear may be performed independently of each other. FIGS. 10 and 11 show an example configuration according to this mode. In this example, as shown in FIG. 10, planar speakers SFL and SFR are attached to the ceiling above the viewer P. The positions of the planar speakers SFL and SFR are determined so that a sound emitted from the planar speaker SFL reaches the left ear but does not reach his or her right ear and a sound emitted from the planar speaker SFR reaches the right ear but does not reach his or her left ear. The speaker SL which is disposed on the front-left of the viewer P emits a sound toward the left ear of the viewer P. The speaker SR which is disposed on the front-right of the viewer P emits a sound toward the right ear of the viewer P.

FIG. 11 shows the configuration of a signal processing system which supplies audio signals to the speakers SL and SR and planar speakers SFL and SFR. As shown in FIG. 11, an audio signal $MD_L$ is supplied to the speaker SL after being processed by an amplification unit 242L and a D/A conversion unit 272L and is also supplied to the planar speaker SFL after being processed by an amplification unit 246L, a filter 260L, and a D/A conversion unit 276L. And an audio signal $MD_R$ is supplied to the speaker SR after being processed by an amplification unit 243L and a D/A conversion unit 273L and is also supplied to the planar speaker SFR after being processed by an amplification unit 246R, a filter 260R, and a D/A conversion unit 276R. For example, the audio signals $MD_L$ and $MD_R$ are an L-channel audio signal and an R-channel audio signal, respectively, that are reproduced from the decoder 12 used in the first embodiment. The filters 260L and 260R are filters having the same function as the filter 260 used in the first embodiment or the filter 260A used in the second embodiment. The gains of the amplification units 243L and 246L are controlled in accordance with a control signal specifying a perceived distance of a sound to be heard by the left ear of the viewer P. The gains of the amplification units 243R and 246R are controlled in accordance with a control signal specifying a perceived distance of a sound to be heard by the right ear of the viewer P.

Various modes are conceivable for the method for generating the control signal specifying a perceived distance of a sound to be heard by the left ear of the viewer P and control signal specifying a perceived distance of a sound to be heard by the right ear of the viewer P. In a preferable mode, these control signals specifying perceived distances are compression-coded and recorded in a recording medium together with audio signals of the respective channels and a video signal. The control signals specifying perceived distances are reproduced from the recording medium together with the audio signals of the respective channels and a video signal in a synchronized manner and used for controlling the gains of the amplification units 242L, 246L, 243R, and 246R. In another preferable mode, these control signals specifying perceived distances are generated by manipulating respective manipulation members.

These modes make it possible to independently control the perceived distance of a sound to be heard by the left ear of the viewer P and the perceived distance of a sound to be heard by the right ear of the viewer P.

It is noted that the speakers SL and SR may be replaced by planar speakers.

Furthermore, separation units as described in the above Modification (8) may be provided. In this configuration, only a signal of a component as a target of the perceived distance control is extracted from the audio signal $MD_L$ and supplied to both of the planar speakers SFL and SL and only a signal of a component as a target of the perceived distance control is extracted from the audio signal $MD_R$ and supplied to both of the planar speakers SFR and SR.

Figure 12:
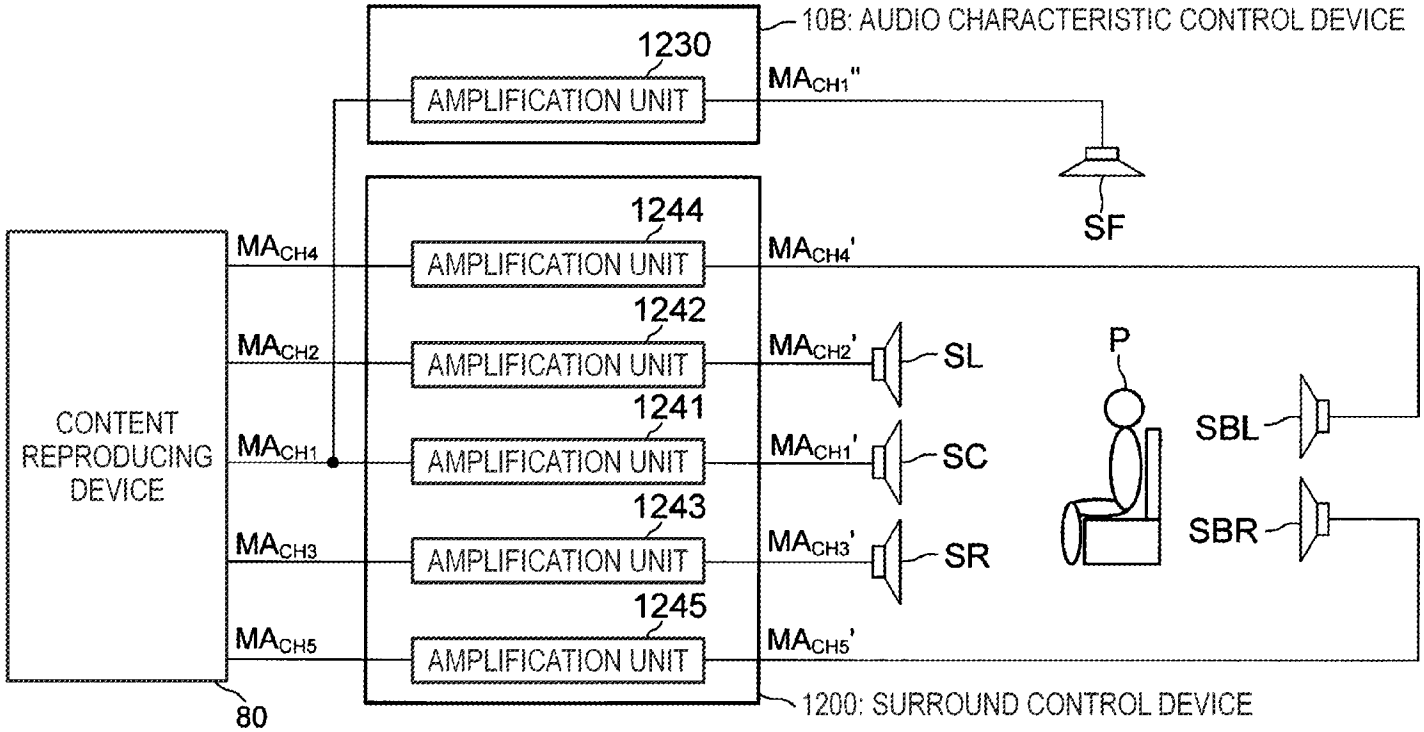
FIG. 12 shows an audio system according to a further embodiment of the invention.

(12) The same advantages as provided by the above-described first to fourth embodiments may be obtained by modifying the first to fourth embodiments so that an audio system which consists of only an audio characteristic control device 10 and a planar speaker SF is constructed and combined with a surround system consisting of speakers SC, SL, SR, SBL, and SBR and devices for driving them. For example, this embodiment is implemented by a configuration shown in FIG. 12. In the example of FIG. 12, a surround system consisting of speakers SC, SL, SR, SBL, and SBR, a content reproducing device 80, and a surround control device 1200 is combined with an audio system consisting of a planar speaker SF and an audio characteristic control device 10B. The speakers SC, SL, SR, SBL, and SBR of the surround system are disposed on the floor or walls of a living room around the viewer P. The content reproducing device 80 outputs an audio signal $MA_{CH1}$ to be supplied to the speaker SC, an audio signal $MA_{CH2}$ to be supplied to the speaker SL, an audio signal $MA_{CH3}$ to be supplied to the speaker SBR, an audio signal $MA_{CH4}$ to be supplied to the speaker SBL, and an audio signal $MA_{CH5}$ to be supplied to the speaker SR. The surround control device 1200 amplifies, at gains specific to the respective signals, the 5-channel signals $MA_{CH1}$, $MA_{CH2}$, $MA_{CH3}$, $MA_{CH4}$, and $MA_{CH5}$ which are output from the content reproducing device 80, and supplies the speakers SC, SL, SR, SBL, and SBR with signals $MA_{CH1}'$, $MA_{CH2}'$, $MA_{CH3}'$, $MA_{CH4}'$, and $MA_{CH5}'$ whose signal levels have been adjusted through the amplification.

Referring to FIG. 12, the planar speaker SF of the audio system is disposed over (almost right above) the viewer P in the living room. The audio characteristic control device 10B is equipped with an amplification unit 1230. The audio characteristic control device 10B takes in the signal $MA_{CH1}$ among the audio signals $MA_{CH1}$, $MA_{CH2}$, $MA_{CH3}$, $MA_{CH4}$, and $MA_{CH5}$ which are output from the content reproducing device 80, amplifies the signal $MA_{CH1}$ at a gain specific to it, and supplies the planar speaker SF with a signal $MA_{CH1}$ whose signal level has been adjusted through the amplification. As in the above-described first embodiment, the gain at which the signal $MA_{CH1}$ is amplified is controlled on the basis of a control signal specifying a perceived distance. In this case, for example, as in the first embodiment, an image signal V reproduced from the content reproducing device 80 is analyzed and a binocular parallax SDF of a display item 10 in an image represented by the signal V is calculated. The calculated binocular parallax SDF may be used as a control signal specifying a perceived distance. Alternatively, a control signal specifying a perceived distance may be generated by manipulating a remote controller. With the above configuration, a sound emitted from the speaker SC of the surround system to the room and a sound emitted from the speaker SF of the audio system to the room are mixed with each other in the space. The distance of sound perceived by the viewer P is controlled in this manner. This configuration can provide the same advantages as in the above-described first to fourth embodiments without the need for altering, to a large extent, the system configuration of the surround system installed in the room.

Although the invention has been described in detail with reference to the particular embodiments, it is apparent to those skilled in the art that various changes and modifications are possible without departing from the spirit and scope of the invention.

The invention makes can provide an audio system which can control the distance of sound a listener feels when hearing sound emitted from speakers.

What is claimed is:

1. An audio system comprising:

plural speakers; and a controller configured to supply audio signals to the plural speakers respectively, wherein the plural speakers include a planar speaker configured to emit a plane wave on the basis of a respective audio signal of the supplied audio signals and a speaker configured to emit a non-plane wave on the basis of another respective audio signal of the supplied audio signals; and wherein the controller is configured to set signal levels of the audio signals to be supplied to the planar speaker and the speaker configured to emit a non-plane wave in accordance with a control signal specifying a perceived distance of sound to be heard by a listener such that the signal level of the audio signal supplied to the planar speaker becomes larger, as the perceived distance of sound heard by the listener is closer.

2. The audio system according to claim 1, wherein the planar speaker is disposed over the listener and is configured to emit the plane wave toward the listener existing below.

3. The audio system according to claim 1, wherein the speaker configured to emit a non-plane wave is disposed in front of the listener and is configured to emit a sound wave toward the listener.

4. The audio system according to claim 1, further comprising:

a filter configured to subject the audio signal to be supplied to the planar speaker to filtering processing for correcting a feature quantity that influences localization in the height direction in a head transfer function of the listener.

5. The audio system according to claim 1, further comprising:

a filter configured to performing filtering processing of convoluting a filter coefficient sequence corresponding to a function that is the reciprocal of a transfer function of an interval from the planar speaker to the listener into the audio signal to be supplied to the planar speaker.

6. An audio system comprising:

a planar speaker;

plural speakers;

an audio signal generating device configured to output audio signals; and a controller configured to generate an audio signal to be supplied to the planar speaker on the basis of an audio signal to be supplied to at least one speaker of the plural speakers among the audio signals output from the audio signal generating device, wherein the planar speaker is configured to emit a plane wave on the basis of the audio signal supplied from the controller;

wherein the at least one speaker is configured to emit a non-plane wave on the basis of the audio signal supplied from the controller; and wherein the controller is configured to set signal levels of the audio signals to be supplied to the planar speaker and the at least one speaker in accordance with a control signal specifying a perceived distance of sound to be heard by a listener such that the signal level of the audio signal supplied to the planar speaker becomes larger, as the perceived distance of sound heard by the listener is closer.

7. An audio characteristic control device which is interposed between an audio signal generating device which generates audio signals and plural speakers including, wherein the plural speakers include a planar speaker configured to emit a plane wave on the basis of a respective audio signal of supplied audio signals and a speaker configured to emit a non-plane wave on the basis of another respective audio signal of the supplied audio signals;

wherein the audio characteristic control device generates an audio signal to be supplied to the planar speaker on the basis of an audio signal to be supplied to the speaker of the plural speakers among the audio signals that are output from the audio signal generating device, and sets signal levels of the audio signals to be supplied to the planar speaker and the speaker in accordance with a control signal specifying a perceived distance of sound to be heard by a listener such that the signal level of the audio signal supplied to the planar speaker becomes larger, as the perceived distance of sound heard by the listener is closer.

* * * * *